US006663462B1

(12) United States Patent
Bettendorf et al.

(10) Patent No.: US 6,663,462 B1
(45) Date of Patent: Dec. 16, 2003

(54) AGGRESSION-RELIEVING STUFFED DOLL

(76) Inventors: Thomas A. Bettendorf, 12 Wildwood Cir., Millville, MA (US) 01529; Michele M. Bettendorf, 12 Wildwood Cir., Millville, MA (US) 01529; Daryl D. Lovejoy, 28 Allard Ct., Millville, MA (US) 01529; Louis C. Lovejoy, 28 Allard Ct., Millville, MA (US) 01529

( * ) Notice: Subject to any disclaimer, the term of this patent is extended or adjusted under 35 U.S.C. 154(b) by 0 days.

(21) Appl. No.: 10/238,500

(22) Filed: Sep. 10, 2002

(51) Int. Cl.[7] ..... A63H 3/02; A63H 3/36
(52) U.S. Cl. ..... 446/369; 446/373
(58) Field of Search ..... 446/368, 369, 446/373, 376

(56) References Cited

U.S. PATENT DOCUMENTS

| | | | | | |
|---|---|---|---|---|---|
| 4,085,540 | A | * | 4/1978 | Jernstrom et al. | 446/333 |
| 4,597,574 | A | * | 7/1986 | Wolfe | 273/403 |
| 4,695,060 | A | * | 9/1987 | Pilgrim | 273/404 |
| 4,729,751 | A | | 3/1988 | Schiavo et al. | |
| 5,195,917 | A | | 3/1993 | Russell et al. | |
| 5,340,348 | A | | 8/1994 | Schroeder | |
| 5,498,001 | A | * | 3/1996 | Franks et al. | 273/403 |
| 5,503,403 | A | * | 4/1996 | Morrell | 273/403 |
| 5,746,639 | A | | 5/1998 | Bloom et al. | |
| D403,031 | S | | 12/1998 | Stousland et al. | |
| 5,842,870 | A | | 12/1998 | Cramer | |
| 6,261,149 | B1 | * | 7/2001 | Moore | 446/369 |
| 6,280,283 | B1 | | 8/2001 | Sisler | |
| 6,575,469 | B2 | * | 6/2003 | Love | 273/403 |

OTHER PUBLICATIONS

Bin Laden Voodoo Dolls !, www.sell.com, Dec. 21, 2001.*
Sports_1937 Stick Pin, www.quanonline.com, Dec. 1, 1998.*

* cited by examiner

*Primary Examiner*—Jacob K. Ackun
*Assistant Examiner*—Faye Francis
(74) *Attorney, Agent, or Firm*—Dale J. Ream

(57) ABSTRACT

An aggression-relieving stuffed doll includes a doll body having a torso, arms, and legs, the doll body being formed of a soft material and filled with soft, stuffing material. A rigid plate is situated in the torso of the doll body and is substantially impenetrable. The invention includes a plurality of pins, each pin having a blunt end simulative of a sports ball and a sharp end capable of penetrating the doll body but not the inner torso plate. Therefore, a user may stick pins into the doll to relieve aggression caused by the simulated sports player although the pin is prevented by the inner plate from penetrating through the back of the doll and into the user's hand.

17 Claims, 5 Drawing Sheets

AGGRESSION-RELIEVING STUFFED DOLL

BACKGROUND OF THE INVENTION

The present application relates generally to dolls and, more particularly, to a stuffed doll in the form of a sports player and having pins that may be selectively inserted into the front of the doll but are prevented from passing entirely through the doll.

Sports fans often become quite agitated or even infuriated by the performance or antics of players on their favorite sports team or the opposing team. It is both entertaining and relieving for these sports fans to have an outlet by which to vent their emotion.

Therefore, it would be desirable to have a stuffed doll that simulates a sports player into which sharp pins may be inserted. Further, it is desirable to have a stuffed doll that may be penetrated by pins while still protecting the person holding the doll from becoming inadvertently wounded by the pins. In addition, it would be desirable to have a stuffed doll with a compartment for holding a plurality of pins.

SUMMARY OF THE INVENTION

A general object of this invention is to provide a stuffed doll that simulates a player on a sports team.

Another object of this invention is to provide a stuffed doll, as aforesaid, that may be partially penetrated by a pin so as to relieve a sports fan's aggression toward an actual player.

Still another object of this invention is to provide a stuffed doll, as aforesaid, which prohibits full penetration by a pin so as to protect a user from being inadvertently wounded by the pin.

Yet another object of this invention is to provide a stuffed doll, as aforesaid, having replaceable indicia for associating the doll with an actual sports player.

An aggression-relieving stuffed sports doll according to the present invention meets the above-mentioned objects and will be described more fully below.

DESCRIPTION OF THE PREFERRED EMBODIMENT

Figure 1:
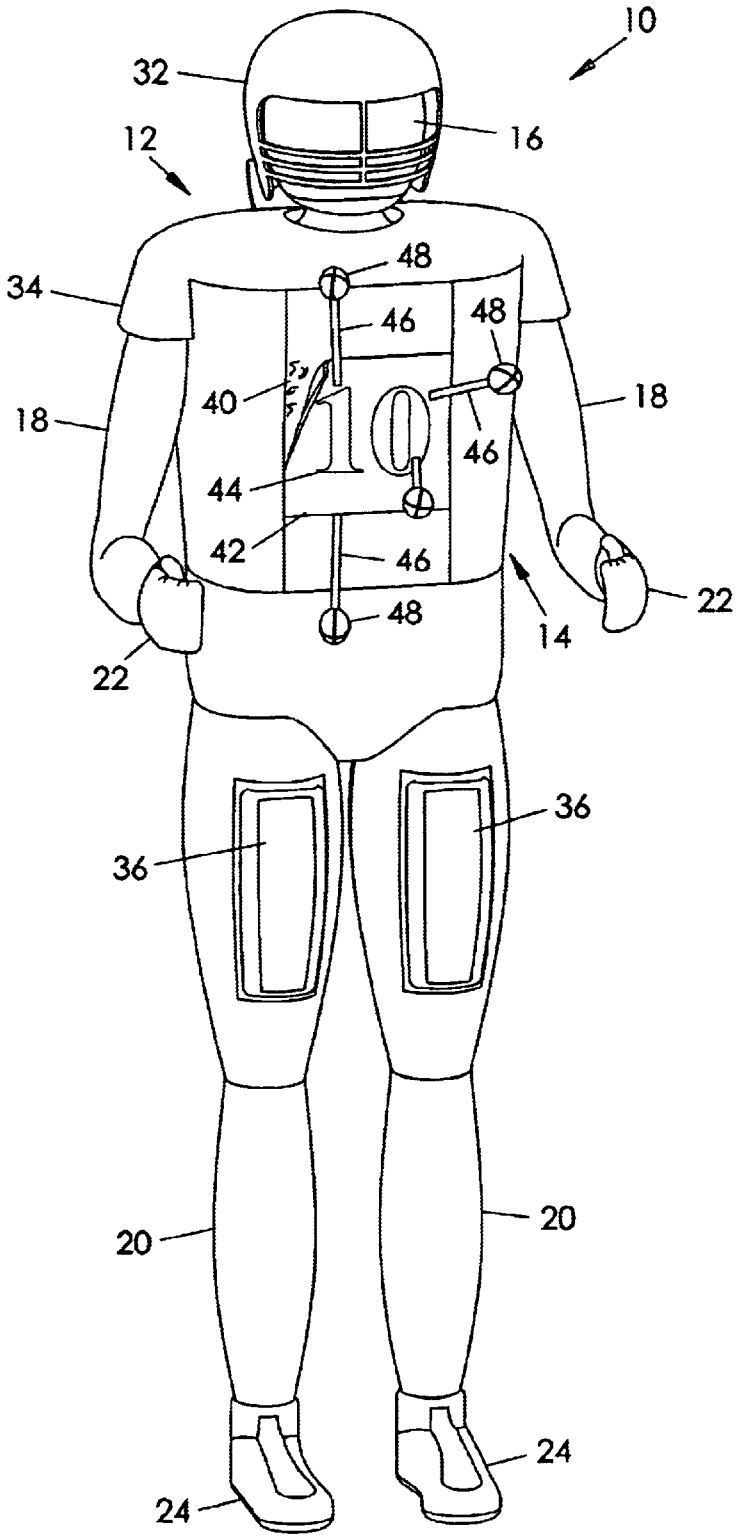
FIG. 1 is a perspective view of a stuffed doll according to a preferred embodiment of the present invention.

An aggression-relieving stuffed doll 10 simulative of a sports player according to a preferred embodiment of the present invention will now be described in detail with reference to FIGS. 1 through 5 of the accompanying drawings. The doll 10 includes a doll body 12 with an inner framework 50 situated therein. More particularly, the doll body 12 includes a torso 14 with a head 16 connected to an upper end thereof (FIG. 1). The doll body 12 also includes a pair of arms 18 fixedly attached to opposed sides thereof. In addition, a pair of legs 20 depend from a lower end of the torso 14 of the doll body 12. Of course, the doll body 12 may include hands 22 and feet 24 as well.

Figure 5:
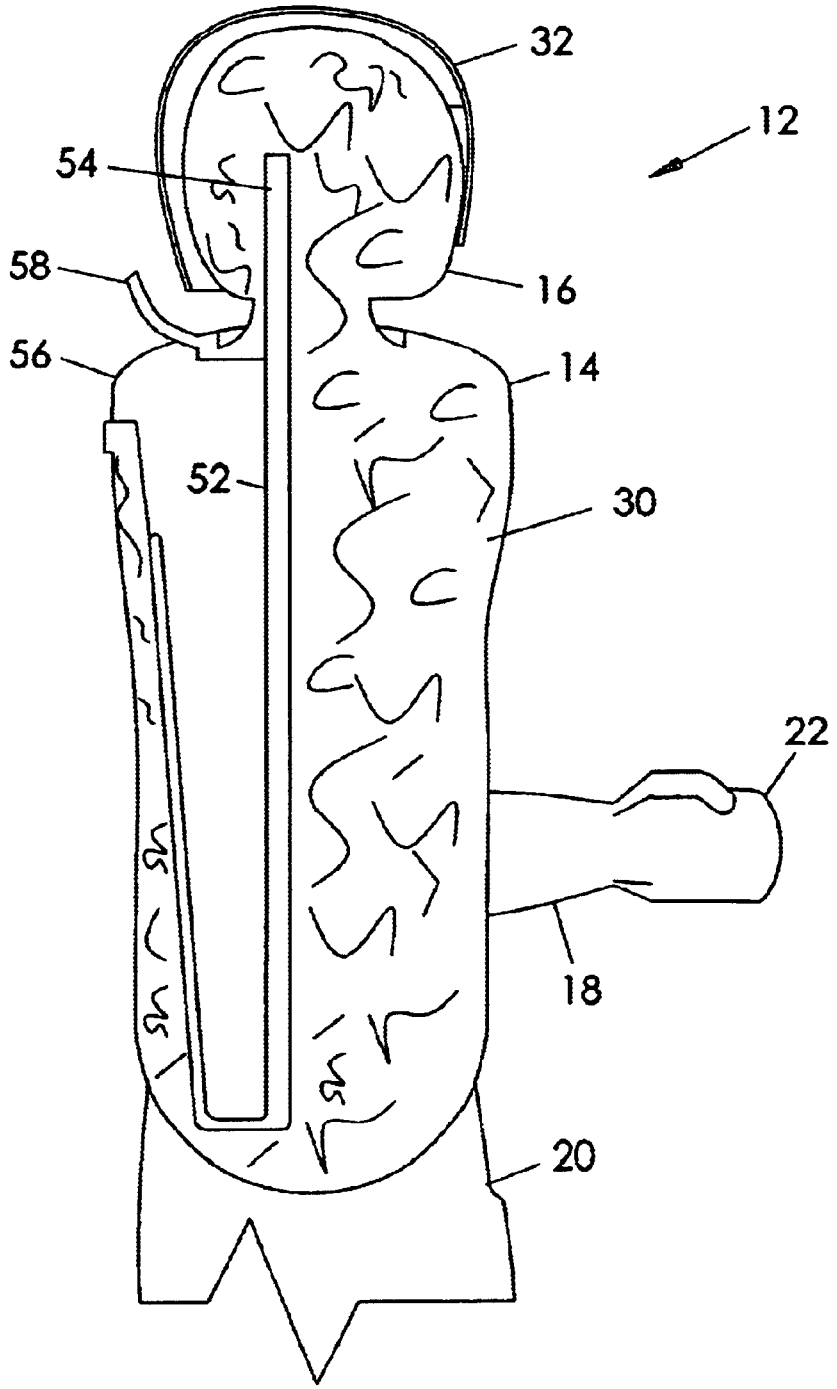
FIG. 5 is a side view of the doll as in FIG. 1 with the outer layer of the doll body broken away.

The doll body 12 includes an outer layer formed of a soft, flexible material substantially filled with a soft, flexible stuffing material 30 (FIG. 5). It is understood that the head, torso, arms, and legs are all substantially filled with stuffing material 30 such as cloth, pellets, foam, or the like. The doll body 12 includes several elements that stimulate a sports player, such as a football player. It should be appreciated, of course, that doll bodies resembling players of other sports would also be suitable, e.g. baseball, hockey, soccer, or basketball players. More particularly, a head covering 32 such as a football helmet is attached to the head 16 of the doll body 12 so as to contribute to the simulation of a football player (FIG. 1). Further, clothing 34 simulative of an appropriate sports player is attached to the torso 14, arms 18, and legs 20 of the doll body 12. It is understood that the clothing may include padded sections to simulate shoulder pads or may include other indicia such as leg pads 36 or the like.

Similarly, the stuffed doll 10 may include player identification means. More particularly, the clothing that is attached to the torso 14 of the doll body 12 (e.g. a player jersey) or the torso 14 itself if no clothing is included includes a player indicia receiving area 40 (FIG. 1). Preferably, the player indicia receiving area 40 includes hook and loop fastening material. The doll also includes a player identification sheet 42 having player identification indicia 44 (i.e. a player number) imprinted on a front side thereof. A rear surface of the sheet 42 includes another hook and loop fastening material 30. Therefore, a player identification sheet 42 having a desired player number may be releasably retained on the doll body 12 by engaging the hook and loop fastening materials. It should be appreciated that multiple identification sheets 42 may be included with the stuffed doll 10 so that player numbers may be interchangeably attached by a user as desired.

Figure 2:
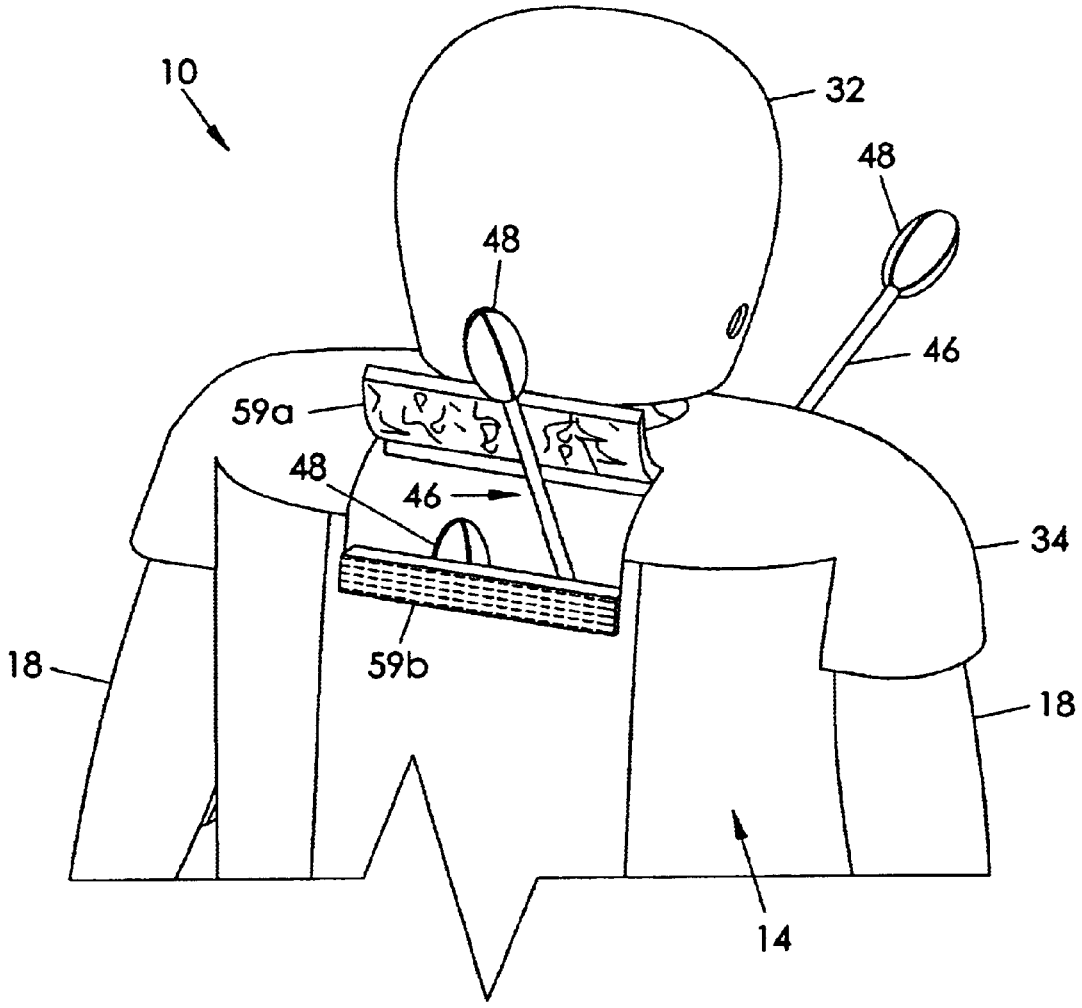
FIG. 2 is a fragmentary rear perspective view of the doll as in FIG. 1.
Figure 3:
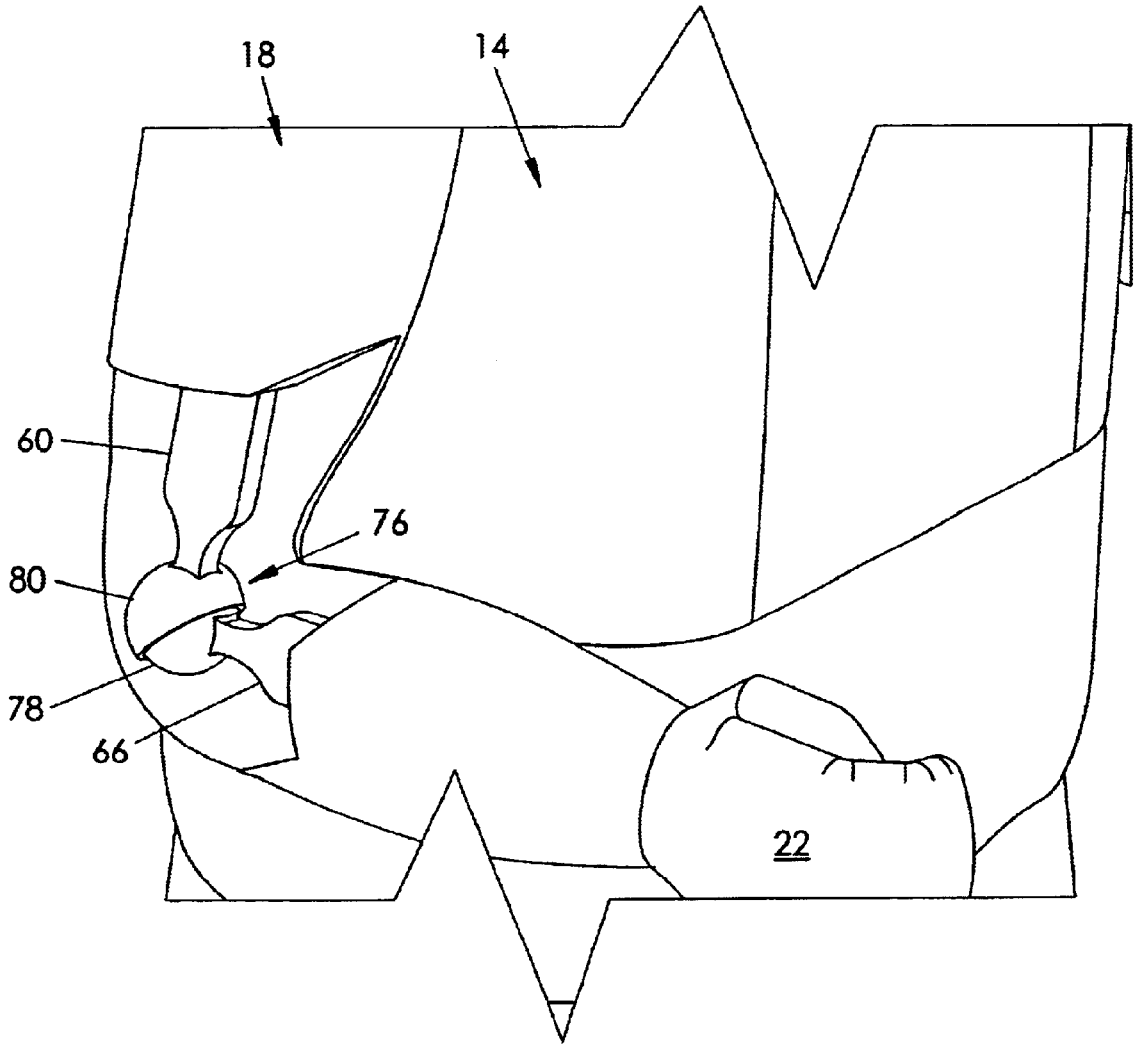
FIG. 3 is a fragmentary view of an arm assembly of the doll as in FIG. 1 with a portion of the doll body broken away.

The stuffed doll 10 according to the preferred embodiment includes a plurality of pins 46. Each pin 46 includes a blunt end 48 in the form of a sports ball, such as a football (FIG. 2). Each pin 46 further includes an opposed sharp end (not shown) that is capable of being inserted into the doll body 12. In other words, the sharp end of each pin may be inserted through the soft, flexible outer layer of a selective portion of the doll body such as the head 16, torso 14, arms 18, or legs 20 (FIG. 1). Once inserted, a pin 46 will be retained therein by the stuffing material 30.

Figure 4:
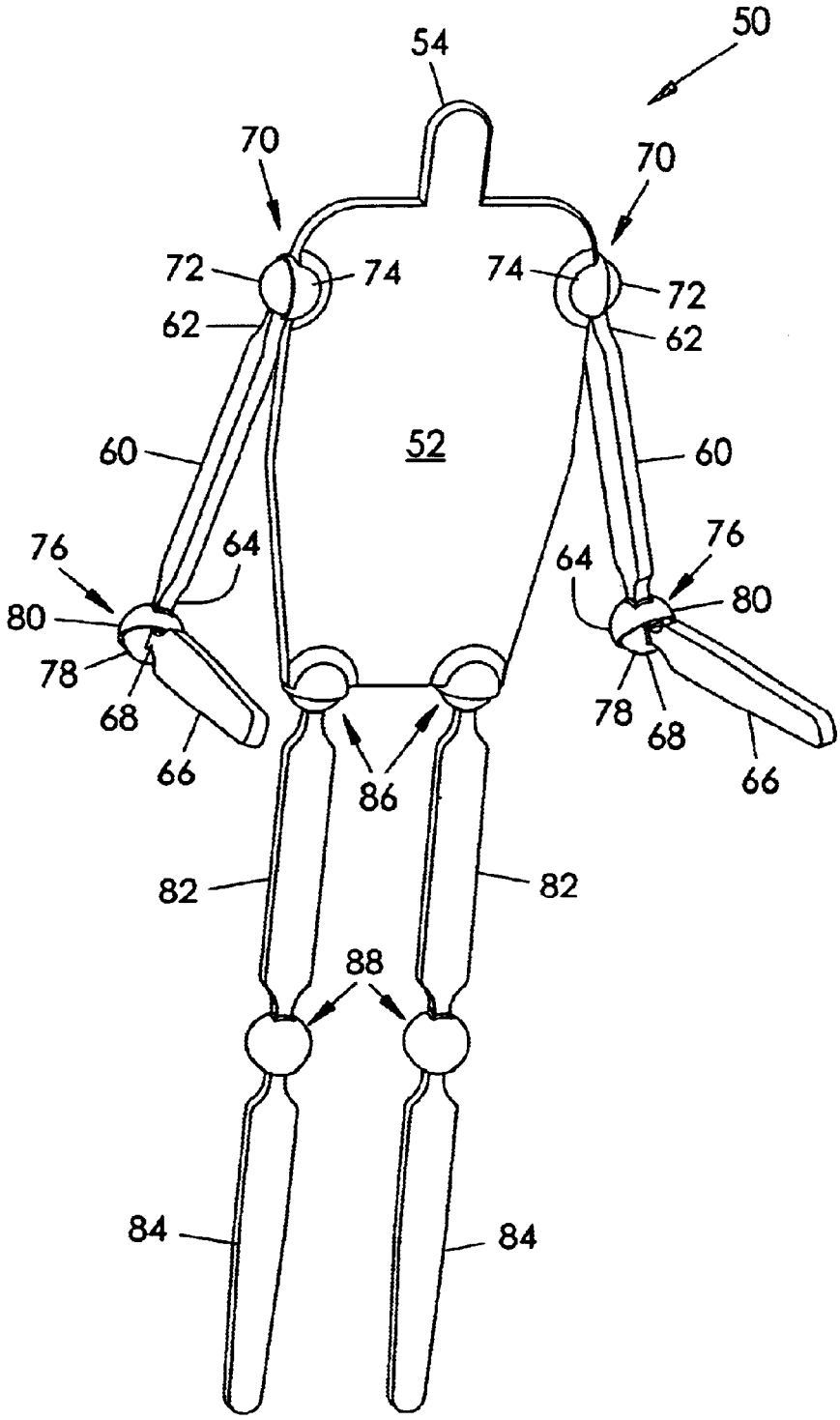
FIG. 4 is a perspective view of the inner plates that are held within the doll body of FIG. 1.

Further, the stuffed doll 10 includes an inner framework 50 that enables movement of the arms 18 and legs 20 and protects a user from inadvertently being pricked by full penetration of a pin through the doll body 12. More particularly, the inner framework 50 includes a torso plate 52 with a head plate 54 fixedly attached thereto (FIG. 4). These plates are constructed of a rigid material that is substantially impenetrable such as ABS plastic, although a polypropylene, nylon, or even metal construction would also work. The torso plate 52 includes a generally V-shaped configuration that forms a receptacle for holding the plurality of pins 46 when not in use (FIG. 5). The torso 14 of the doll body 12 defines an opening 56 giving access to the receptacle and through which pins 46 may be inserted or removed. A cover 58 may be pivotally coupled to the torso 14 such that the receptacle opening 56 may be selectively covered. The cover 58 may be coupled with a hinge or just be constructed out of flexible material (e.g. a flap). The cover 58 may be held in a closed configuration using hook and loop fastening materials 59*a*, 59*b* (FIG. 2).

It should be appreciated that most of the stuffing material 30 is positioned in front of the torso and head plates into which the pins 46 may be freely inserted. The substantially impenetrable plates then form a barrier through which the pins 46 may not penetrate. The torso and head plates 52, 54 include height and width dimensions that are substantially equal to the dimensions of the torso 14 and head 16, respectively, of the doll body 12 so as to prevent the complete penetration described above. This construction prevents the pins from penetrating completely through the doll body and impaling a user's hand.

The inner framework 50. includes a pair of arm assemblies positioned within the arms 18 of the doll body 12 (FIG. 4). Each arm assembly includes first 60 and second 66 arm segments constructed of a generally impenetrable material similar to the rigid material described previously. The first arm segments 60 include respective opposed first 62 and second 64 ends. The inner framework 50 includes a pair of first arm coupling elements 70 for coupling first ends 62 of respective first arm segments 60 to opposed sides of the torso plate 52. Each first arm coupling element 70 includes a ball section 72 and a socket section 74 capable of rotatably retaining a corresponding ball section 72. The ball and socket sections of each first arm coupling element 70 maintain a relatively tight friction fit relationship such that the first arm segments 60 will maintain whatever orientation a user adjusts them to. The inner framework 50 also includes a pair of second arm coupling elements 76 for coupling respective first ends 68 of the second arm segments 66 with corresponding second ends 64 of respective first arm segments 60. Each second arm coupling element 76 includes ball 78 and socket 80 sections having a construction substantially similar to the first arm coupling elements 70 previously described.

The inner framework 50 further includes a pair of leg assemblies, each leg assembly having substantially impenetrable first 82 and second 84 leg segments. In the same manner as described previously, respective first leg segments 82 are coupled to a bottom edge of the torso plate 52 with first leg coupling elements 86. Respective second leg segments 84 are coupled to corresponding first leg segments 82 with second leg coupling elements 88. The leg coupling elements are preferably constructed of ball and socket combinations although other rotatable or pivotal constructions, such as hinges, would also be suitable.

It is understood that the stuffed sports dolls according to this invention may present various colors and players from various sports. The dolls may also be formed as referees, umpires, or other usual participants. It is also contemplated that sets of team indicia may be included so that a user may customize the doll to a particular team.

In use, the plurality of pins 46 are first stored in the receptacle but may be removed through the receptacle opening 56 when needed. A user may place the desired player identification sheet 42 on the front of the torso 14 and may orient the arms 18 and legs as desired. When aggravated by an actual sports player, the user may remove one or more pins 46 from the receptacle and insert them into the doll body 12 at desired locations. The pins 46 will easily penetrate the doll body 12 but will be prevented by the inner plates from going all the way through. Player identification sheets 42 may be interchanged as desired and the pins 46 may be removed and stored in the receptacle when finished.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An aggression-relieving stuffed doll, comprising:

a doll body having clothes and indicia indicative of a sports player having a torso with a head, arms, and legs connected to said torso, said doll body formed of a soft, flexible material and having a soft stuffing material therewith in;

a torso plate situated within said torso of said doll body, said torso plate having a rigid construction that is substantially impenetrable and having a height and width that are substantially equal to a height and width of said torso of said doll body; and wherein said torso plate includes a generally V-shaped configuration forming a receptacle for holding said plurality of pins, said torso of said doll body defining an opening for selectively inserting or removing said pins into or from said receptacle.

2. The doll as in claim 1 further comprising a plurality of pins, each pin having a blunt end having a configuration in the shape of a sports ball and an opposed sharp end adapted to penetrate said doll body.

3. The doll as in claim 1 further comprising a head covering in the form of a helmet attached to said head of said doll body.

4. The doll as in claim 3 further comprising:

a player identification sheet having player identification indicia on a front side thereof and having one of a hook and loop fastening material on a back side thereof; and an attachment portion on said clothes attached to said torso, said attachment portion having another of a hook and loop fastening material for mating with said one of a hook and loop fastening material, whereby to releasably retain said player identification sheet on said attachment portion.

5. The doll as in claim 1 further comprising:

a sheet having player identification indicia imprinted thereon; and means for releasably attaching said sheet to said torso of said doll body.

6. The doll as in claim 1 further comprising:

a pair of arm assemblies positioned within respective arms of said doll body, each arm assembly having substantially impenetrable first and second arm segments;

a pair of first arm coupling elements for coupling respective first arm segments to opposed sides of said torso plate;

a pair of second arm coupling elements for coupling respective second arm segments to corresponding first arm segments.

7. The doll as in claim 6 wherein said pairs of first and second arm coupling elements include ball and socket combinations, each ball and socket combination having a ball section and a socket section adapted to rotatably retain a corresponding ball section therein.

8. The doll as in claim 1 further comprising:

a pair of leg assemblies positioned within respective legs of said doll body, each leg assembly having substantially impenetrable first and second leg segments;

a pair of first leg coupling elements for coupling respective first leg segments to said torso plate;

a pair of second leg coupling elements for coupling respective second leg segments to corresponding first leg segments; and wherein said pairs of first and second leg coupling elements include ball and socket combinations, each ball and socket combination having a ball section and a socket section adapted to rotatably retain a corresponding ball section therein.

9. An aggression-relieving stuffed doll, comprising:

a doll body having clothes and indicia indicative of a sports team player having a torso with a head and arms connected thereto and having a pair of legs depending from said torso, said doll body being formed of a soft, flexible material and having a soft stuffing material therewithin;

a torso plate situated within said torso of said doll body, said torso plate having a rigid construction that is substantially impenetrable and having a height and width that are substantially equal to a height and width of said torso of said doll body;

a plurality of pins, each pin having a blunt end simulative of a sports ball and an opposed sharp end capable of penetrating said doll body and incapable of penetrating said torso plate positioned within said doll body; and wherein said torso plate includes a generally V-shaped configuration forming a receptacle for holding said plurality of pins, said torso of said doll body defining an opening for selectively inserting said plurality of pins into or removing said plurality of pins from said receptacle.

10. The doll as in claim 9 further comprising a cover pivotally coupled to said torso of said doll body for selectively covering or revealing said opening.

11. The doll as in claim 10 further comprising:

a helmet attached to said head of said doll body, and clothes attached to said torso, arms, and legs of said doll body having indicia indicative of a sports team.

12. The doll as in claim 11 further comprising:

a player identification sheet having player identification indicia on one side and having one of a hook and loop fastening material on another side; and an attachment portion on said clothes attached to said torso, said attachment portion having another of a hook and loop fastening material for mating with said one of a hook and loop fastening material, whereby to releasably retain said player identification sheet on said attachment portion.

13. The doll as in claim 9 further comprising:

a sheet having player identification indicia imprinted thereon; and means for releasably attaching said sheet to said torso of said doll body.

14. The doll as in claim 9 further comprising a head plate connected to said torso plate and situated in said head of said doll body, said head plate having a rigid construction that is substantially impenetrable.

15. The doll as in claim 9 further comprising:

a pair of arm assemblies positioned within respective arms of said doll body, each arm assembly having substantially impenetrable first and second arm segments;

a pair of first arm coupling elements for coupling respective first arm segments to opposed sides of said torso plate;

a pair of second arm coupling elements for coupling respective second arm segments to corresponding first arm segments; and wherein said pairs of first and second arm coupling elements include ball and socket combinations, each ball and socket combination having a ball section and a socket section adapted to rotatably retain a corresponding ball section therein.

16. The doll as in claim 9 further comprising:

a pair of leg assemblies positioned within respective legs of said doll body, each leg assembly having substantially impenetrable first and second leg segments;

a pair of first leg coupling elements for coupling respective first leg segments to said torso plate;

a pair of second leg coupling elements for coupling respective second leg segments to corresponding fist leg segments; and wherein said pairs of first and second leg coupling elements include ball and socket combinations, each ball and socket combination having a ball section and a socket section adapted to rotatably retain a corresponding ball section therein.

17. An aggression-relieving stuffed doll, comprising:

a doll body having clothes, indicia, and a generally human shape indicative of a sports team player having a torso with a head and arms connected thereto and having a pair of legs depending from said torso, said doll body being formed of a soft, flexible material and having a soft stuffing material therewithin;

a torso plate situated within said torso of said doll body, said torso plate having a rigid construction that is substantially impenetrable and having a height and width that are substantially similar to a height and width of said torso of said doll body;

a plurality of pins, each pin having a blunt end simulative of a sports ball and an opposed sharp end capable of penetrating said doll body and incapable of penetrating said torso plate within said doll body;

wherein said torso plate includes a generally V-shaped configuration forming a receptacle for holding said plurality of pins, said torso of said doll body defining an opening for selectively inserting said plurality of pins into or removing said plurality of pins from said receptacle;

a head covering attached to said head of said doll body simulative of a sports player; clothes attached to said torso, arms, and legs of said doll body simulative of a sports player;

a sheet having player identification indicia imprinted thereon;

means for releasably attaching said sheet to said torso of said doll body;

a pair of arm assemblies positioned within respective arms of said doll body, each arm assembly having substantially impenetrable first and second arm segments;

a pair of first arm coupling elements for coupling respective first arm segments to opposed sides of said torso plate;

a pair of second arm coupling elements for coupling respective second arm segments to corresponding first arm segments; and wherein said pairs of first and second arm coupling elements include ball and socket combinations, each ball and socket combination having a ball section and a socket section adapted to rotatably retain a corresponding ball section therein.

* * * * *